US005245978A

United States Patent [19]

Orzel

[11] Patent Number: 5,245,978

[45] Date of Patent: Sep. 21, 1993

[54] CONTROL SYSTEM FOR INTERNAL COMBUSTION ENGINES

[75] Inventor: Daniel V. Orzel, Westland, Mich.

[73] Assignee: Ford Motor Company, Dearborn, Mich.

[21] Appl. No.: 932,512

[22] Filed: Aug. 20, 1992

[51] Int. Cl.[5] ..... F02D 41/14

[52] U.S. Cl. ..... 123/674; 123/696; 123/698

[58] Field of Search ..... 123/674, 696, 698

[56] References Cited

U.S. PATENT DOCUMENTS

| | | | |
|---|---|---|---|
| 4,467,769 | 8/1984 | Matsumura | 123/674 |
| 4,641,623 | 2/1987 | Hamburg | 123/518 |
| 4,677,956 | 7/1987 | Hamburg | 123/520 |
| 4,715,340 | 12/1987 | Cook et al. | 123/406 |
| 4,741,318 | 5/1988 | Kortge et al. | 123/520 |
| 4,748,959 | 6/1988 | Cook et al. | 123/520 |
| 4,763,634 | 8/1988 | Morozumi | 123/520 |
| 4,841,940 | 6/1989 | Uranishi et al. | 123/694 |
| 4,865,000 | 9/1989 | Yajima | 123/520 |
| 4,867,126 | 9/1989 | Yonekawa et al. | 123/520 |
| 4,932,386 | 6/1990 | Uozumi et al. | 123/520 |
| 4,961,412 | 10/1990 | Furuyama | 123/520 |
| 4,967,713 | 11/1990 | Kojima | 123/696 |
| 5,048,492 | 9/1991 | Davenport et al. | 123/674 |
| 5,048,493 | 9/1991 | Orzel et al. | 123/674 |
| 5,090,388 | 2/1992 | Hamburg et al. | 123/674 |

*Primary Examiner*—Andrew M. Dolinar
*Attorney, Agent, or Firm*—Allan J. Lippa; Roger L. May

[57] ABSTRACT

A control system (10) controls fuel injected into an internal combustion engine (14) having a fuel vapor recovery system (74) coupled to the air/fuel intake. To achieve stoichiometric combustion, delivery of liquid fuel is trimmed by a feedback variable (32) responsive to an exhaust gas oxygen sensor (26) and a learned value (40) representing quantity of recovered fuel vapor. Learning (40) is inhibited when an indication is provided of air/fuel operation rich of stoichiometry which is caused by factors other than vapor recovery.

12 Claims, 4 Drawing Sheets

CONTROL SYSTEM FOR INTERNAL COMBUSTION ENGINES

BACKGROUND OF THE INVENTION

The field of the invention relates to air/fuel ratio control of engines having fuel vapor recovery systems.

For an engine having a fuel vapor recovery system coupled between a fuel system and engine air/fuel intake, feedback control systems are known which generate a feedback variable by integrating the output of an exhaust gas oxygen sensor. Liquid fuel injected into the engine is trimmed in response to the feedback variable in an attempt to maintain stoichiometric combustion.

A modification to this conventional system has been proposed wherein a second feedback system adaptively learns the inducted quantity of recovered fuel vapors. The difference between the feedback variable and a reference corresponding to stoichiometry is integrated to generate the learned value. Delivery of injected fuel is then reduced by the learned value to maintain stoichiometric combustion while purging fuel vapors from the fuel vapor recovery system. The inventor herein has recognized a problem with the proposed approach. When the engine is operating rich of stoichiometry because of factors other than vapor purging, such as deceleration, the rich offset may be erroneously learned as purged fuel vapor. An erroneous air/fuel correction may therefore be provided.

SUMMARY OF THE INVENTION

An object of the invention claimed herein is to prevent adaptive learning of rich engine operation as recovered fuel vapors.

The above object and others are achieved, and problems of prior approaches overcome, by providing both a control system and method for controlling air/fuel operation of an engine having a fuel vapor-recovery system coupled between a fuel system and an air/fuel intake of the engine, comprising: feedback control means coupled to an exhaust gas oxygen sensor for controlling the fuel inducted into the engine to achieve a stoichiometric mixture of inducted air, fuel, and fuel vapors; the feedack means including learning means for learning mass flow rate of the inducted fuel vapors and correcting the inducted fuel in response to the learned vapor flow; and inhibiting means for providing a predication of a rich offset from the stoichiometric mixture and for inhibiting the learning by the learning means in response to the prediction.

An advantage obtained by the above aspect of the invention over proposed air/fuel control systems is that erroneous learning of a rich air/fuel offset as purged vapor quantity is avoided when the rich offset is caused by factors other than vapor purging such as, for example, vehicular deceleration.

BRIEF DESCRIPTION OF THE DRAWINGS

The object and advantages of the invention claimed herein and others will be more clearly understood by reading an example of an embodiment in which the invention is used to advantage, referred to herein as the Preferred Embodiment, with reference to the attached drawings wherein:

DESCRIPTION OF THE PREFERRED EMBODIMENT

Figure 1:
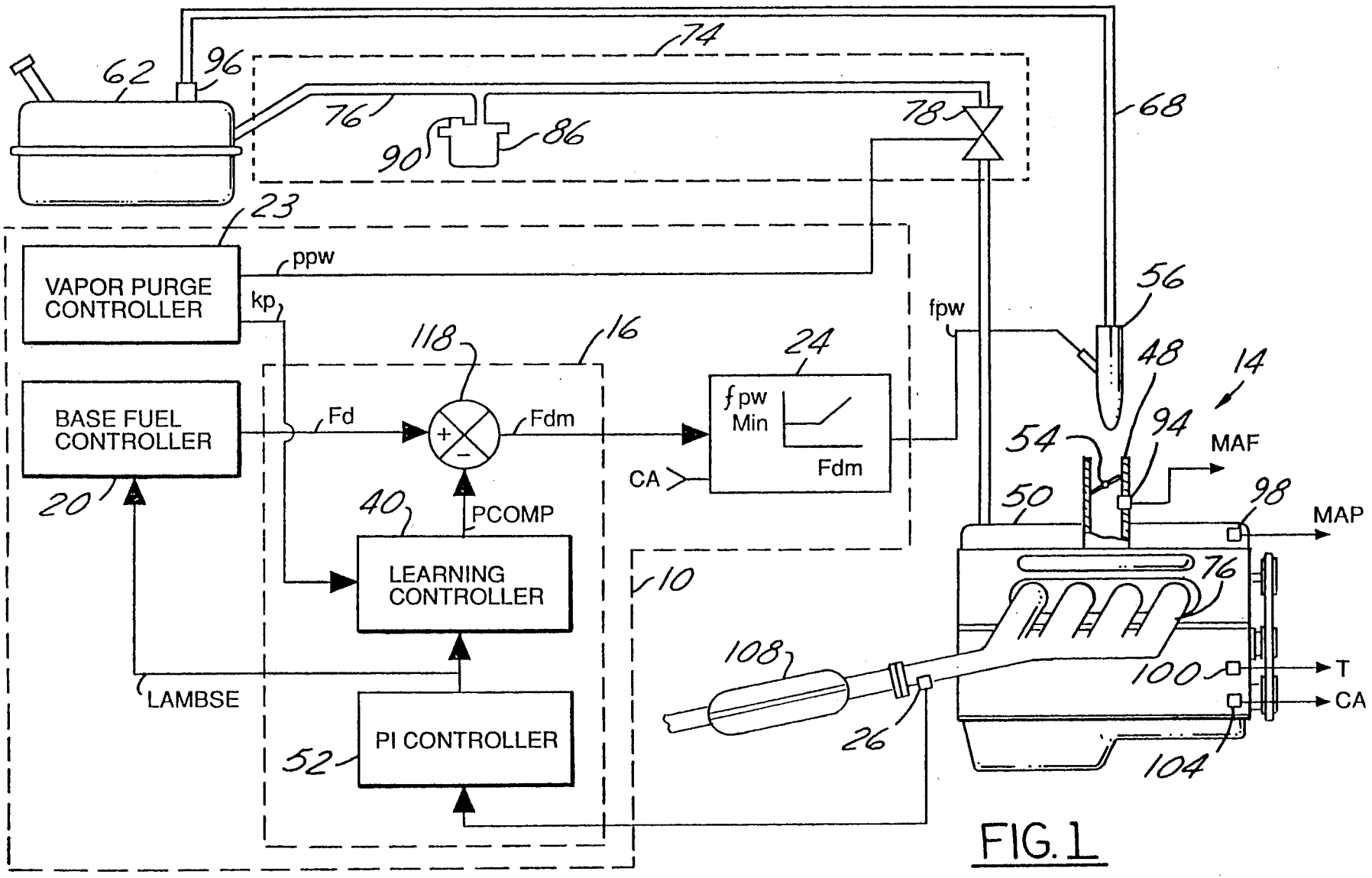
FIG. 1 is a block diagram of an embodiment wherein the invention is used to advantage.

Referring first to FIG. 1, control system or controller 10 is here shown controlling delivery of both liquid fuel and recovered or purged fuel vapor to engine 14. As described in greater detail later herein, controller 10 is shown including feedback control system 16, base fuel controller 20, fuel controller 24, and vapor purge controller 28. Feedback control system 16 is shown including PI controller 32 and learning controller 40. PI controller 32 is a proportional plus integral controller, in this particular example, which generates feedback correction value LAMBSE responsive to exhaust gas oxygen sensor (EGO) 36. Learning controller 40 generates purge compensation feedback variable PCOMP which is representative of the mass flow rate of purged fuel vapors inducted into engine 14.

Engine 14 is shown as a central fuel injected engine have throttle body 48 coupled to intake manifold 50. Fuel injector 56 injects a predetermined amount of fuel into throttle body 48 during the pulse width of actuating signal fpw provided by controller 24 as described in greater detail later herein. Fuel is delivered to fuel injector 56 by a conventional fuel system including fuel tank 62, fuel pump 66, and fuel rail 68.

Fuel vapor recovery system 74 is shown coupled between fuel tank 62 and intake manifold 50 via electronically actuated purge control valve 78. In this particular example, the cross sectional area of purge control valve 78 is determined by the duty cycle of actuating signal ppw from purge controller 28 in a conventional manner. Fuel vapor recovery system 74 includes canister 86 connected in parallel to fuel tank 62 for absorbing fuel vapors therefrom by activated charcoal contained within the canister.

During fuel vapor recovery, commonly referred to as vapor purge, air is drawn through canister 86 via inlet vent 90 absorbing hydrocarbons from the activated charcoal. The mixture of air and recovered fuel vapors is then inducted into manifold 50 via purge control valve 78. Concurrently, recovered fuel vapors from fuel tank 62 are drawn into intake manifold 50 through valve 78. Accordingly, a mixture of purged air and recovered fuel vapors from both fuel tank 62 and canister 86 are purged into engine 14 by fuel vapor recovery system 74 during purge operations.

Conventional sensors are shown coupled to engine 14 for providing indications of engine operation. In this example, the sensors include: mass air flow sensor 94 providing a measurement of mass air flow (MAF) inducted into engine 14; manifold pressure sensor 98 providing a measurement (MAP) of absolute manifold pressure in intake manifold 50; temperature sensor 70 providing a measurement of engine operating temperature (T); engine speed sensor 104 providing a measurement of engine speed (rpm) and crank angle (CA).

Engine 14 also includes exhaust manifold 106 coupled to conventional three-way ($NO_x$,CO,HC) catalytic convertor 108. EGO sensor 26, a conventional two-state oxygen sensor in this example, is shown coupled to exhaust manifold 106 for providing an indication of air/fuel ratio operation of engine 14. EGO sensor 26 provides an output signal having a high state when air/fuel operation is at the rich side of reference or desired air/fuel ratio $A/F_D$. In this particular example, $A/F_D$ is selected for stoichiometric combustion (14.7 lbs. air/1 lb. fuel). When engine air/fuel operation is lean of stoichiometry, EGO sensor 26 provides its output signal at a low state.

Base fuel controller 20 provides desired fuel charge signal Fd by dividing signal MAF by both feedback value LAMBSE and desired air/fuel ratio $A/F_D$ as shown by the following.

$$Fd = \frac{MAF}{(A/F_D)\ LAMBSE}$$

Desired fuel charge signal Fd is then reduced by the quantity of fuel supplied by recovered fuel vapors (i.e., purge compensation signal PCOMP) in subtracter 118 to generate modified desired fuel charge signal Fdm. Fuel controller 24 converts signal Fdm into fuel pulse width signal fpw with an "on" time or pulse width which actuates fuel injector 56 for the time period required to deliver the desired quantity of fuel.

In this particular example, fuel controller 24 is a look-up table addressed by signal Fdm. In the schematic representation of this look-up table shown in FIG. 1, signal Fdm is shown linearly related to signal fpw. Fuel pulse width signal fpw is shown clipped at the minimum pulse of the linear operating range of fuel injector 56. If fuel injector 56 was actuated with a pulse width less than this minimum value, the fuel delivered therethrough may not be linearly related to actuating pulse width and accurate air/fuel control may not be maintained by controller 10. In addition, the fuel atomization may be degraded at actuating pulse widths less than the minimum pulse width.

Figure 2:
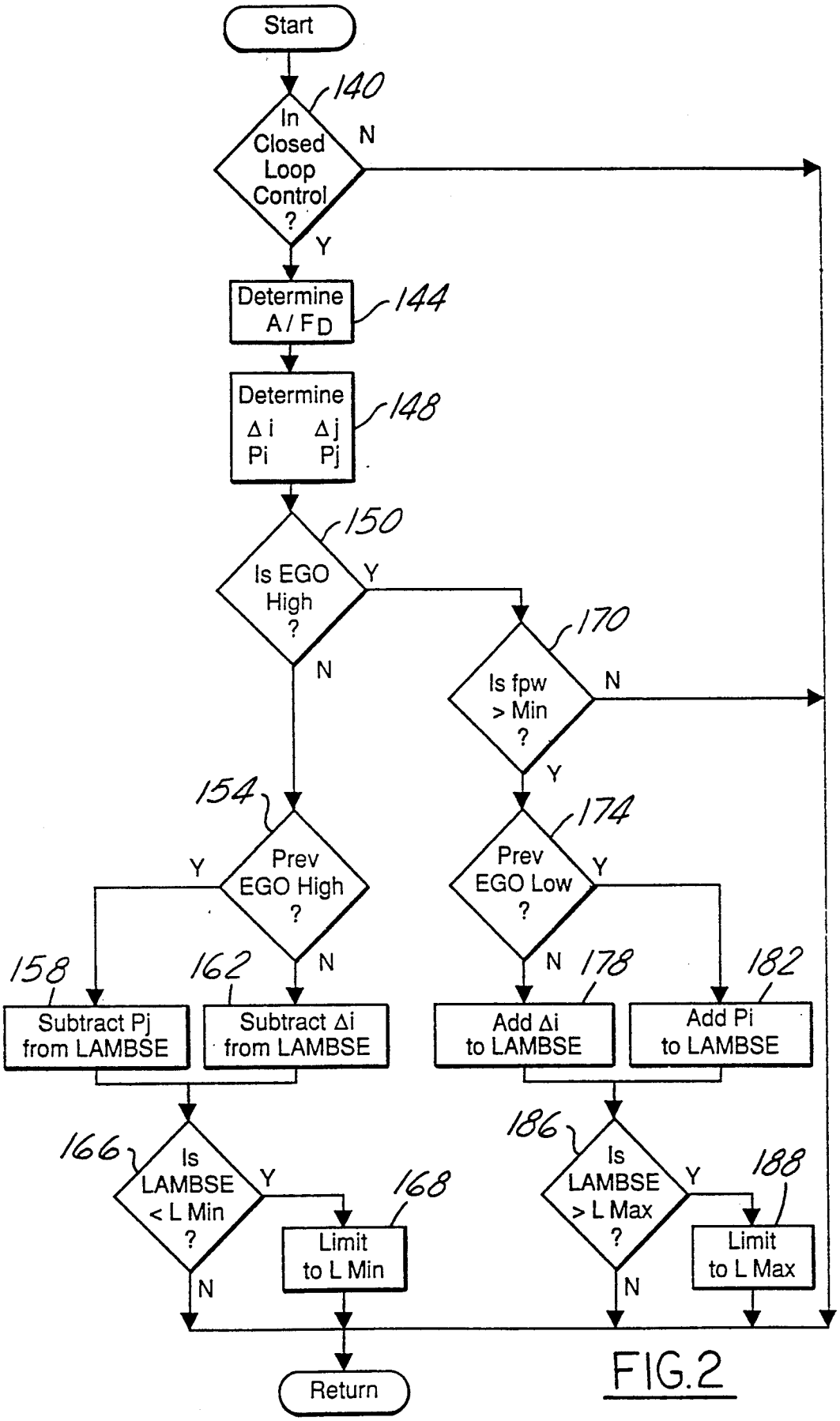
FIG. 2 is a high level flowchart illustrating steps performed by a portion of the embodiment illustrated in FIG. 1.

Operation of PI controller 32, is now described with reference to the flowchart shown in FIG. 2 and continuing reference to FIG. 1. After a determination is made that closed loop (i.e., feedback) air/fuel control is desired in step 140, desired air/fuel ratio ($A/F_D$) is determined in step 144. The proportional terms (Pi and Pj) and integral terms (Δi and Δj) are then determined in step 148 to achieve an air/fuel operation which averages at $A/F_D$.

EGO sensor 26 is sampled in step 150 during each background loop of the microprocessor. When EGO sensor 26 is low (i.e., lean), but was high (i.e., rich) during the previous background loop (step 154), proportional term Pj is subtracted from LAMBSE in step 158. When EGO sensor 26 is low, and was also low during the previous background loop, integral term Δj is subtracted from LAMBSE in step 162. Accordingly, in this particular example of operation, proportional term Δj represents a predetermined rich correction which is applied when EGO sensor 26 switches from rich to lean. Integral term Δj represents an integration step to provide continuously increasing rich fuel delivery while EGO sensor 26 continues to indicate combustion lean of stoichiometry.

After LAMBSE has been decreased to provide a rich fuel correction (steps 158 or 162), LAMBSE is compared to its minimum value (LMin) in step 166. LMin corresponds to the lower limit of the operating range of authority of PI controller 32. When LAMBSE is less than LMin, it is limited to this value in step 168.

Operation of PI controller 32 is now described under circumstances when EGO sensor 26 is high (step 150) and fuel pulse width signal fpw greater than its minimum value (step 170). When EGO sensor 26 is high, but was low during the previous background loop (step 174), proportional term Pi is added to LAMBSE in step 182. When EGO sensor 26 is high, and was also high during the previous background loop, integral term Δi is added to LAMBSE in step 178. Proportional term Pi represents a proportional correction in a direction to decrease fuel delivery when EGO sensor 26 switches from lean to rich, and integral term Δj represents an integration step in a fuel decreasing direction while EGO sensor 26 continues to indicate combustion rich of stoichiometry.

During step 186, after LAMBSE has been corrected in a fuel decreasing direction (step 178 Or 182), LAMBSE is compared to its maximum value (LMax) which corresponds to the upper limit of the operating range of authority of PI controller 32. When LAMBSE is greater than LMax, it is limited to this value in step 168.

Referring back to steps 150 and 170, when EGO sensor 26 indicates combustion rich of stoichiometry and fuel pulse width signal fpw is less than its minimum value, LAMBSE is not incremented and the program is exited. Accordingly, PI controller 32 is inhibited from providing further air/fuel corrections in the lean or fuel decreasing direction when fuel pulse width signal fpw is less than its minimum value. Without so inhibiting LAMBSE, desired fuel charge signal Fd would be reduced even though fuel injector 56 may be unable to deliver the lower fuel quantity demanded.

Figure 3:
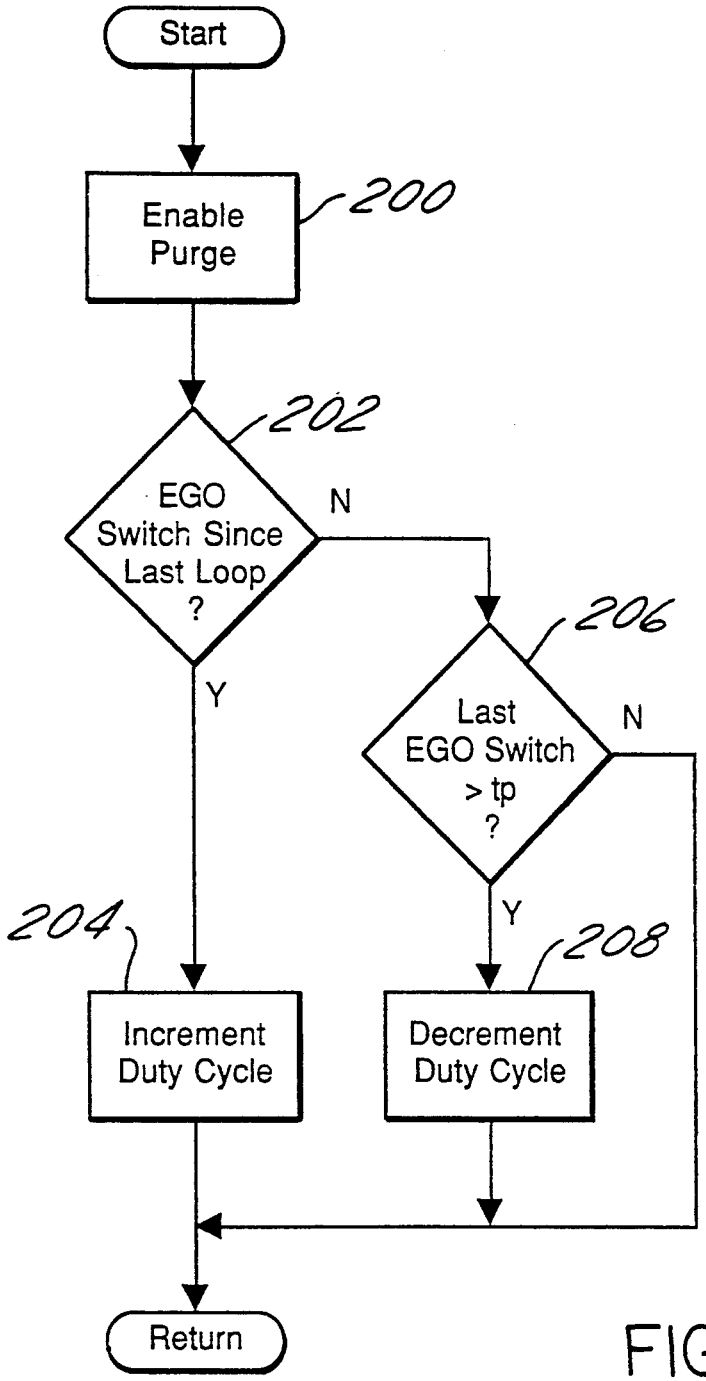
FIG. 3 is a high level flowchart illustrating steps performed by a portion of the embodiment illustrated in FIG. 1.
Figure 4:
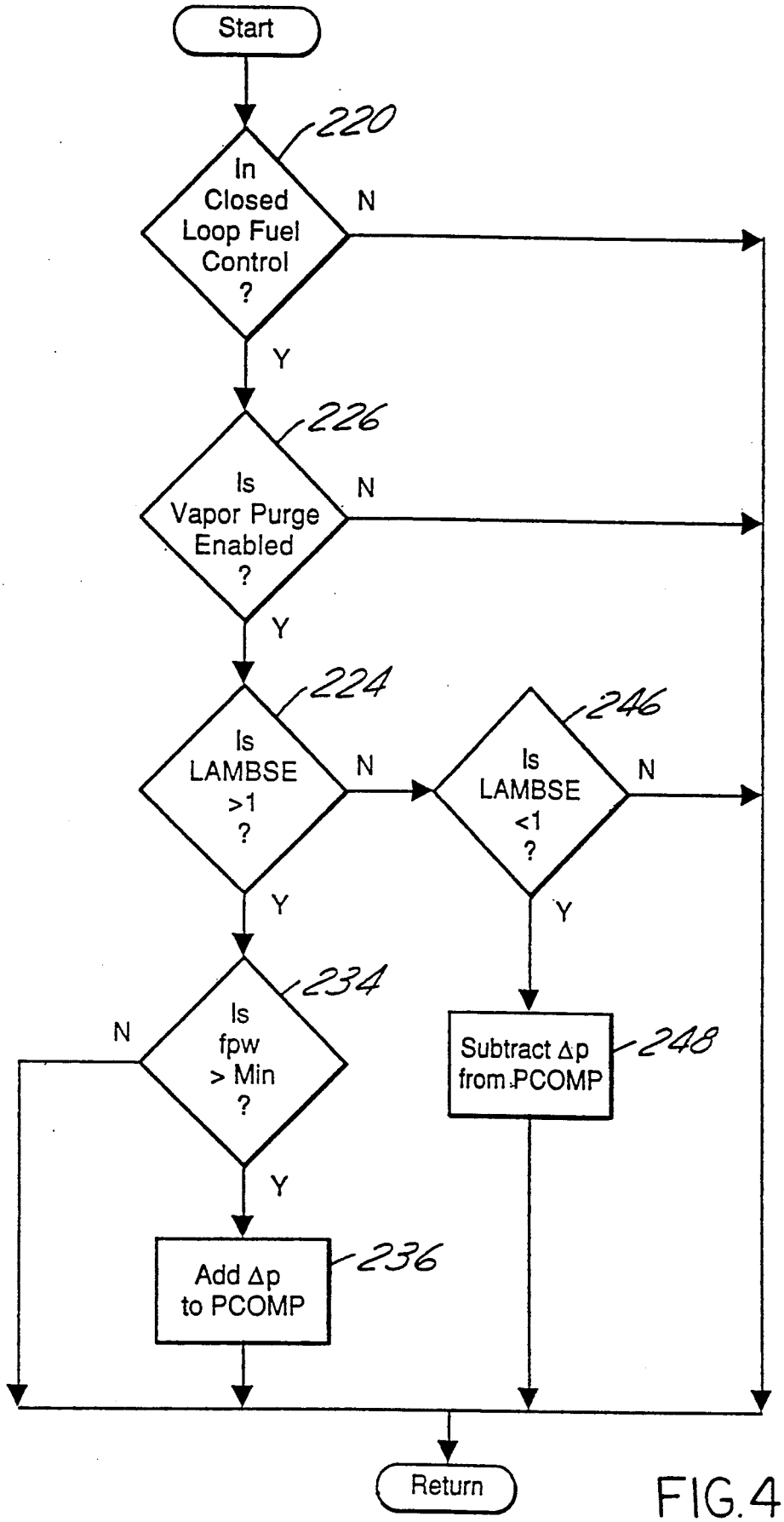
FIG. 4 is a high level flowchart illustrating steps performed by a portion of the embodiment illustrated in FIG. 1.

Operation of vapor purge controller 28 and vapor learning controller 40 are now described with reference to FIGS. 3 and 4, respectively, and continuing reference to FIG. 1. The operational steps performed by vapor purge controller 28 are first described with particular reference to FIG. 3. During step 200, vapor purge operations are enabled in response to engine operating parameters such as engine temperature. Thereafter, the duty cycle of signal ppw, which actuates purge valve 78, is incremented a predetermined time when EGO sensor 26 has switched states since the last program background loop (see steps 202 and 204). If there has not been a switch in states of EGO sensor 26 during predetermined time tp, such as two seconds, the purge duty cycle is decremented by a predetermined amount (see steps 202, 206, and 208).

In accordance with the above described operation of vapor purge controller 28, the rate of vapor flow is gradually increased with each change in state of EGO sensor 26. In this manner, vapor flow is turned on at a gradual rate to its maximum value (typically 100% duty cycle) when indications (i.e., EGO switching) are provided that PI controller 32 and vapor recovery learning controller 40 are properly compensating for purging of fuel vapors.

The operation of vapor recovery learning controller 40 is now described with reference to process steps shown in FIG. 4. When controller 10 is in closed loop or feedback air/fuel control (step 220), and vapor purge is enabled (step 226), LAMBSE is compared to its reference or nominal value, which is unity in this particular example. If LAMBSE is greater than unity (step 224), indicating a lean fuel correction is being provided, and fuel pulse width signal fpw is greater than its minimum value (step 234), signal PCOMP is incremented by integration value Δp during step 236. The liquid fuel delivered is therefore decreased, or leaned, by Δp each sample time when LAMBSE is greater than unity. This process of integrating continues until LAMBSE is forced back to unity.

When LAMBSE is less than unity (step 246) integral value Δp is subtracted from PCOMP during step 248. Delivery of liquid fuel is thereby increased and LAMBSE is again forced towards unity.

In accordance with the above described operation, vapor recovery learning controller 40 adaptively learns the mass flow rate of recovered fuel vapors. Delivery of liquid fuel is corrected by this learned value (PCOMP) to maintain stoichiometric combustion while fuel vapors are recovered or purged.

The learning process described above is inhibited when a lean fuel correction is provided by LAMBSE (step 224) and there is an indication of a rich air/fuel offset caused by a condition other than vapor purging. In this particular example, that offset indication is provided when the fuel pulse width is less than a minimum value (step 234). Such a condition may occur, for example, during deceleration when the fuel injector may not be capable of accurately delivering a sufficiently small quantity of fuel to maintain stoichiometry. Engine 14 will therefore run rich and the process of inhibiting integration will prevent the erroneous learning of such rich offset.

This concludes the description of the preferred embodiment. The reading of it by those skilled in the art will bring to mind many alterations and modifications without departing from the spirit and scope of the invention. For example, LAMBSE may trim the base fuel quantity by providing a multiplicative factor in which case the output polarities of the EGO sensor would be reversed. Further, although a proportional plus integral feedback controller is shown, other feedback controllers may be used to advantage such as a pure integral controller or a derivative plus integral controller. Accordingly, it is intended that the scope of the invention be limited only by the following claims.

What is claimed:

1. A control system for controlling a mixture of air, fuel and fuel vapor inducted into an internal combustion engine having a fuel vapor recovery system coupled between a fuel system and an air/fuel intake of the engine, comprising:

feedback control means coupled to an exhaust gas oxygen sensor for controlling the fuel inducted into the engine to achieve a stoichiometric mixture of inducted air, fuel, and fuel vapors;

said feedback means including learning means for learning mass flow rate of the inducted fuel vapors and correcting the inducted fuel in response to said learned vapor flow; and inhibiting means for providing a prediction of a rich offset from said stoichiometric mixture and for inhibiting said learning by said learning means in response to said prediction.

2. The control system recited in claim 1 wherein said rich offset prediction provided by said inhibiting means comprises an indication of both a lean fuel correction provided by said feedback means and an indication of inducted fuel being less than a minimum value.

3. The control system recited in claim 2 wherein said feedback means controls said inducted liquid fuel by controlling a pulse width of an electrical signal actuating at least one fuel injector and said indication of inducted fuel being less than said minimum value provided by said inhibiting means comprises an indication of said pulse width being less than a minimum pulse width.

4. A control system for controlling a fuel injected internal combustion engine having a fuel vapor recovery system coupled between a fuel system and an air/fuel intake of the engine, comprising:

first feedback control means for providing a first feedback signal by integrating an exhaust gas oxygen sensor output;

second feedback control means for learning inducted quantity of the recovered fuel vapors by comparing said first feedback signal to a reference associated with stoichiometric combustion and providing a second feedback signal by integrating in a direction determined by said comparison;

actuation means for providing an actuating signal to one or more of the fuel injectors with a pulse width related to both said first feedback signal and said second feedback signal; and inhibiting means for inhibiting said fuel vapor learning by said second feedback control means when said pulse width is less than a predetermined pulse width.

5. The control system recited in claim 4 wherein said inhibiting means inhibits said integration.

6. The control system recited in claim 4 wherein said inhibiting means inhibits said integration when said pulse width is less than a predetermined pulse width and said first feedback signal is at a value which decreases fuel delivered to the engine.

7. The control system recited in claim 4 wherein said reference associated with stoichiometric combustion is unity.

8. The control system recited in claim 4 wherein said first feedback signal is related to variation in the inducted mixture of air and injected fuel from stoichiometry.

9. A method for controlling a fuel injected internal combustion engine having a fuel vapor recovery system coupled between a fuel system and an air/fuel intake of the engine, comprising the steps of:

generating an actuating signal for one or more of the fuel injectors having a pulse width related to both airflow inducted into the engine and a first feedback signal and a second feedback signal;

providing said first feedback signal by integrating an output of an exhaust gas sensor;

providing said second feedback signal by comparing said integrated exhaust gas sensor output to a reference value associated with stoichiometric combustion, and adding predetermined increments having a sign determined by said integration wherein said second feedback signal is related to quantity of inducted fuel vapors; and inhibiting said addition when said pulse width is less than a predetermined pulse width.

10. The method recited in claim 9 wherein said step of integrating further comprises adding a product of a proportional value times said exhaust gas oxygen sensor output to said integrated output to provide said first feedback signal.

11. The method recited in claim 9 wherein said inhibiting step is responsive to both said fuel pulse width and said first feedback signal being greater than a predetermined value.

12. The method recited in claim 9 wherein said step of generating an actuating signal provides said pulse width by dividing said airflow by a reference air/fuel ratio and then subtracting said second feedback signal.

* * * * *